US007639202B2

(12) United States Patent
Takaoka et al.

(10) Patent No.: US 7,639,202 B2
(45) Date of Patent: Dec. 29, 2009

(54) ANTENNA APPARATUS

(75) Inventors: Akira Takaoka, Okazaki (JP); Noriaki Okada, Chiryu (JP)

(73) Assignees: DENSO CORPORATION, Kariya (JP); Nippon Soken, Inc., Nishio (JP)

( * ) Notice: Subject to any disclaimer, the term of this patent is extended or adjusted under 35 U.S.C. 154(b) by 35 days.

(21) Appl. No.: 12/040,232

(22) Filed: Feb. 29, 2008

(65) Prior Publication Data

US 2008/0224945 A1 Sep. 18, 2008

(30) Foreign Application Priority Data

Mar. 12, 2007 (JP) ..... 2007-062462

(51) Int. Cl.
*H01Q 1/36* (2006.01)

(52) U.S. Cl. ..... 343/895

(58) Field of Classification Search ..... 343/895, 343/702, 722, 793, 821, 859
See application file for complete search history.

(56) References Cited

U.S. PATENT DOCUMENTS

| | | | | |
|---|---|---|---|---|
| 5,359,340 | A * | 10/1994 | Yokota | 343/792 |
| 5,818,398 | A | 10/1998 | Tsuru et al. | |
| 5,841,407 | A * | 11/1998 | Birnbaum | 343/895 |
| 5,859,621 | A * | 1/1999 | Leisten | 343/895 |
| 6,160,512 | A | 12/2000 | Desclos et al. | |
| 6,501,437 | B1 | 12/2002 | Gyorko et al. | |
| 6,690,336 | B1 * | 2/2004 | Leisten et al. | 343/895 |
| 7,084,825 | B2 * | 8/2006 | Sakae et al. | 343/788 |
| 7,183,998 | B2 * | 2/2007 | Wilhelm et al. | 343/895 |
| 7,439,934 | B2 * | 10/2008 | Leisten et al. | 343/895 |
| 2006/0290590 | A1 | 12/2006 | Takaoka et al. | |
| 2007/0040749 | A1 | 2/2007 | Jeon et al. | |
| 2007/0200786 | A1 | 8/2007 | Takaoka et al. | |

FOREIGN PATENT DOCUMENTS

| | | |
|---|---|---|
| JP | 10-041722 | 2/1998 |
| JP | 11-214914 | 8/1999 |
| JP | 2000-349534 | 12/2000 |
| JP | 2003-152427 | 5/2003 |

(Continued)

OTHER PUBLICATIONS

Japanese Office Action dated Jan. 13, 2009 issued in corresponding Japanese Application No. 2007-062462, with English translation.

*Primary Examiner*—Huedung Mancuso
(74) *Attorney, Agent, or Firm*—Nixon & Vanderhye, PC

(57) ABSTRACT

An antenna apparatus includes a substrate having a GND pattern land and an electric power feed pattern land on a same surface, an outer element extending away from the land in a spiral shape, and an inner element extending along an axis of the outer element in a spiral shape with a space interposed between itself and the outer element. The outer element and the inner element of the antenna apparatus respectively serve as one of a signal line and a GND line, and are supported by a retainer member to have predetermined relationship on a land formation surface. The retainer member is made of dielectric body, and the two elements respectively have a surface mount portion at one end that is to be fixed onto the substrate with electrical connection to corresponding lands. The surface mount portions are formed substantially parallel to the land formation surface.

7 Claims, 5 Drawing Sheets

FOREIGN PATENT DOCUMENTS

| | | |
|---|---|---|
| JP | 2003-273629 | 9/2003 |
| JP | 2004-048471 | 2/2004 |
| JP | 2004-064353 | 2/2004 |
| JP | 2007-013318 | 1/2007 |
| JP | 2007-43653 | 2/2007 |
| JP | 2007-221374 | 8/2007 |
| WO | WO 91/15621 | 10/1991 |

* cited by examiner

ANTENNA APPARATUS

CROSS REFERENCE TO RELATED APPLICATION

The present application is based on and claims the benefit of priority of Japanese Patent Application No. 2007-62462 filed on Mar. 12, 2007, the disclosure of which is incorporated herein by reference.

FIELD OF THE INVENTION

The present disclosure generally relates to an antenna apparatus for use in a vehicle or the like.

BACKGROUND INFORMATION

The antenna apparatus for use in a communication apparatus such as a remote keyless entry system for vehicular/home use that uses relatively short wavelength of UHF, VHF band has a large portion of its body volume occupied by an antenna element. Therefore, volume reduction of the antenna element is important in terms of volume reduction of the antenna apparatus.

Japanese patent document JP-A-2003-152427 discloses a volume reduction structure of the antenna apparatus. The disclosed structure has a linear inside conductor and an outer coil conductor that is densely wound at a distance from the inside conductor for providing specific resonance frequency. In this manner, the antenna device is aimed at achieving high gain with reduced body volume.

The structure disclosed in the above-identified document has the liner inside conductor, and that sets a limit for volume reduction. For example, to reduce the antenna size in a direction that is perpendicular to the extending direction of the inside conductor, at least one of the inside conductor and the outside coil conductor has to have an extended length. In this case, the linearity of the inside conductor contributes to the increase of the body volume by large amount.

On the other hand, Japanese patent document JP-A-2007-43653 (US2006/0290590) filed by the inventor of the present invention discloses a structure that has an inside conductor element in a spiral shape extending along an axis of the outside conductor element at an inside of the outside element, in which one of the elements serves as a signal line and the other serves as a GND line. In this manner, the inside element in a spiral shape achieves a narrow band for an improved gain, thereby enabling the body volume reduction for the same gain. Further, Japanese patent document JP-A-2007-221374 (US2007/0200786) discloses an antenna holder structure for holding the antenna apparatus on a substrate. In view of the above disclosure, further volume reduction is sought about for implementation efficiency.

SUMMARY OF THE INVENTION

In view of the above and other problems, the present disclosure provides an antenna apparatus that achieves a body volume reduction without compromising its performance.

The antenna apparatus of the present invention includes: a substrate having a GND pattern land and a power supply pattern land disposed on a same surface; an antenna element including an external element that has a helically extending portion extending away from a land formation surface of the substrate and an internal element that has another helically extending portion extending along an axis of the external element at an inside of the external element in a detached manner from the external element; a retainer in contact with the external element and the internal element on the land formation surface for retaining the external element and the internal element in a predetermined positional relationship with each other. One of the two elements included in the antenna element serves as a signal line and an other of the two elements included in the antenna element serves as a GND line, and the retainer is made of a dielectric material. Further, each of the external element and the internal element has a surface mount portion that is, as a connecting end to the helically extending portion, substantially parallel with the land formation surface of the substrate on one end that is used for fixation on the substrate, and the surface mount portion of each of the two elements is connected to respectively different lands.

The antenna apparatus of the present invention holds the two elements in predetermined positional relationships, thereby maintains the performance of the antenna apparatus.

Further, dielectric used for forming the retainer achieves a wavelength shortening effect for the high frequency current, thereby enabling a volume reduction in terms of high of the antenna element from a land formation surface of the substrate.

Furthermore, each of the elements has a connection portion that accommodates surface mounting by reflow for integrated implementation of the two elements in one action, thereby enabling further implementation efficiency. That is, the two elements are held by the retainer as a single piece for implementation.

BRIEF DESCRIPTION OF THE DRAWINGS

Other objects, features and advantages of the present invention will become more apparent from the following detailed description made with reference to the accompanying drawings, in which.

DETAILED DESCRIPTION

In the following, embodiments of the present invention are explained based on the drawings

FIRST EMBODIMENT

Figure 1:
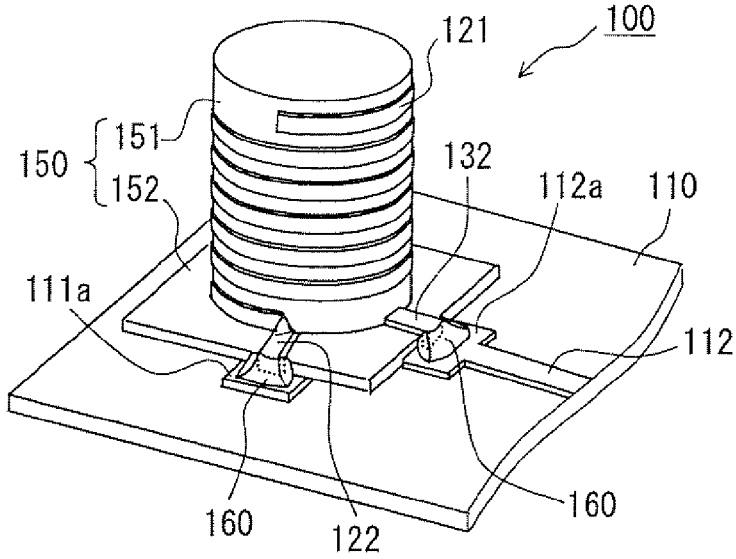
FIG. 1 shows a perspective view of an antenna device in a first embodiment of the present invention.
Figure 2:
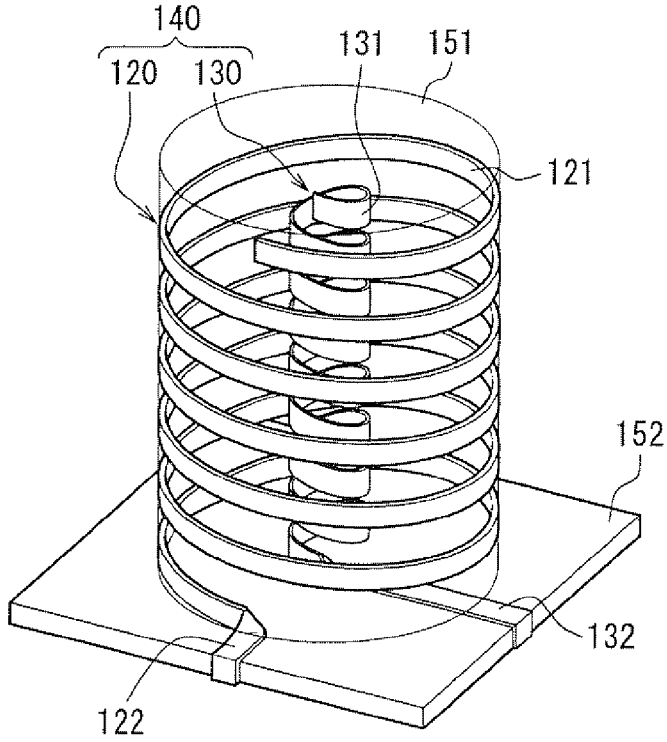
FIG. 2 shows a perspective view of an antenna in FIG. 1.
Figure 3:
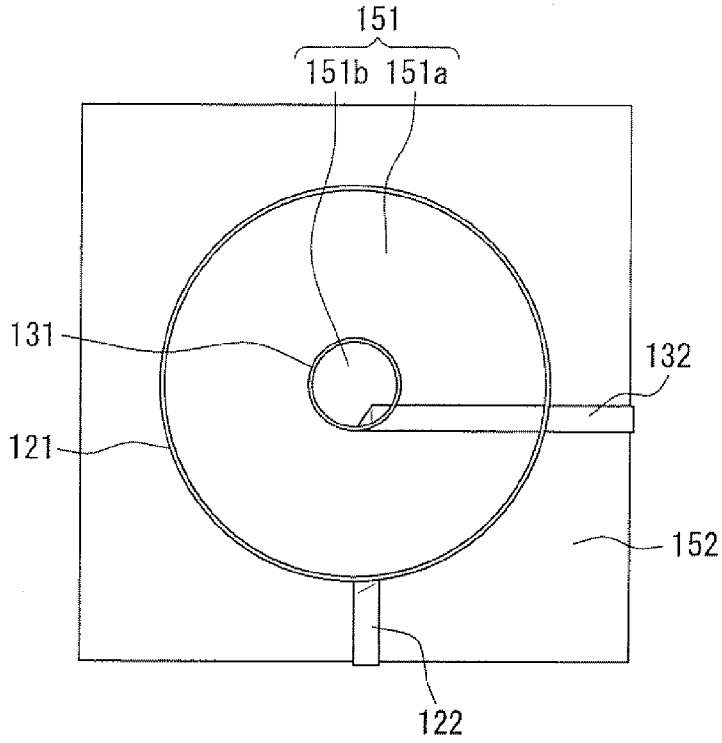
FIG. 3 shows a top view of the antenna in FIG. 2.
Figure 4:
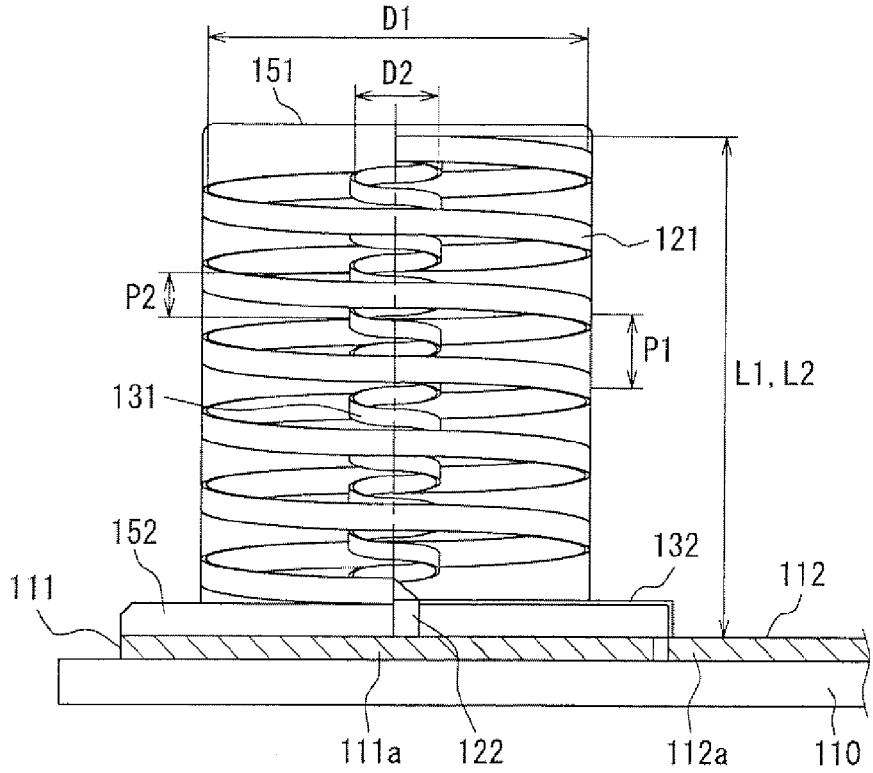
FIG. 4 shows a side view of the antenna in FIG. 2.

FIG. 1 is a perspective illustration showing an outline configuration of the essential part of an antenna device of a first embodiment of the present invention (the first embodiment). FIG. 2 is a perspective view around the antenna device in FIG. 1. FIG. 3 is a top view of the antenna device in FIG. 2 from a board top surface side. FIG. 4 is a side view of the antenna device in FIG. 2 from a side of the antenna device. In addition, in FIG. 2 and FIG. 3, the illustrations only show the antenna device and a retainer member for convenience of viewing. Further, solder in the FIG. 4 is omitted.

The antenna device in the present embodiment is formed as a receiver of a keyless remote system of a vehicle. An antenna device 100 has, as a main portion, a board 110 and two elements, that is, an outside element 120 and an inside element 130, with an antenna 140 implemented to the board 110 and a retainer member 150 that holds the outside element 120 and the inside element 130 in predetermined positions as shown in FIGS. 1 to 4.

As shown in FIGS. 1 and 4, the board 110 has on one surface of a base made of insulators(for example, resin of dielectric constant value around 3), as lands for surface-mounting ends of each of the elements 120, 130, a land 111*a* of a GND pattern 111 and a land 112*a* of a power feeding pattern 112. Those lands are on the same side of the board. The lands 111*a*, 112*a* as well as the GND pattern 111 and the feeding pattern 112 are formed on a land forming face of the board 110 as shown in FIG. 4 in the present embodiment. For a placement of the antenna 140 in correspondence to the GND pattern 111, the GND pattern 111 is established substantially in the shape of a plane rectangle on the land forming face of the board 110. And the land 111a projects along the land forming face of the board 110 from the plane rectangle-shaped GND pattern 111. In addition, a land 112*a* is formed in the proximity of the GND pattern 111, and the feeding pattern 112 is established in the direction pointing away from the GND pattern 111 with the land 112*a* as one end. Further, a received signal from the antenna 140 is configured to be output through an adjustment element (not illustrated) which is used for impedance matching to the RF (Radio Frequency) circuit (also not illustrated) by the feeding pattern 112.

In addition, in the present embodiment, the RF circuit is disposed on a board that is different from the board 110. However, the RF circuit may be disposed integrally on the board 110 in addition, the land 111*a* may be connected to the GND pattern 111 through a connection wiring and a connection via. In that case, elements such as condensers or the like may be arranged in a part of the connection wiring.

The antenna 140 has, as shown in FIGS. 2 to 4, the outside element 120 having a whorl portion 121 extending away from the land forming face of the board 110 in a spiral forming manner and the inside element 130 having a whorl portion 131 extending in a spiral forming manner along an axial direction of the outside element 120 in the direction away from the land forming face of the board 110 at an inside of the outside element 120 in a detached manner. One of the two elements 120, 130 serving as a signal line, and the other serving as a GND line, the antenna forms an L(inductance)C (capacitance) series resonant circuit. Because the configuration and the details of effectiveness of the antenna 140 are mentioned in Japanese patent document JP-A-2007-43653, the details are not mentioned in the embodiment.

A conductor wire in a plane spiral form forms, with an inside diameter D1, a pitch P1 between spirals, the outside element 120 as shown in FIG. 4 in the present embodiment. In addition, the conductor wire in a plane spiral form forms, with an inside diameter D2 which is smaller than D1 and a pitch P2 between spirals which is smaller than the pitch P1) the inside element 130. A height L1 of the outside element 120 from the land forming face of the board 110 and a height L2 of the inside element 130 from the land forming face of the board 110 are substantially made equal with each other. Because a second electric current by an electric current passed to the outside element 120 acts on the inside element 130 efficiently in the above configuration, an antenna gain can be effectively improved. In other words, it can reduce a volume of the antenna 140. Further, each of the elements 120, 130 is disposed to have respective axes aligned with each other as shown in an alternate dot-dash line in FIG. 4. Furthermore, the spiral shape of each of the elements 120, 130 may be formed as a polygon except for a rectangle as well as a roughly circular shape or the like.

By forming the inside element 130 in the spiral shape, the direction of the electric current in the inside element 130 and the direction (a vector) of the second electric current (an image electric current) in the inside element 130 that is generated by the electric current in the outside element 120 becomes approximately same, thereby enabling an effective composition of these electric currents. In addition, an unnecessary electric current except for the electric current about the electric wave being used is prevented from flowing because the electric current forms a spiral shape. Therefore, a band is defined in a narrow range, and results in an improved antenna gain. In other words, the volume of the antenna 140, or the volume of the antenna device 100 that includes the antenna 140 disposed on the board 110, can be reduced in comparison to the antenna having a linear inside element if the same amount of the antenna gain is expected In addition, each of the elements 120, 130 has surface mount portions 122, 132 respectively as an end connected to the whorl portions 121, 131 on a side of the corresponding land 111*a*, 112*a* of the board 110. Further, each of the surface mount portions 122, 132 is connected to respectively different lands 111*a*, 112*a*. As the board 110 can have a collective implementation of the two elements 120, 130 by reflow when a surface mount structure is adopted in the above-described manner the implementation of the two elements 120, 130 on the board 110 is more efficient. In the present embodiment, each of the elements 120, 130 is collectively implemented on the board 110 by reflow.

The surface mount portions 122, 132 may at least have a part that is substantially parallel to the land forming face of the board 110. In the present embodiment, one end of each of the elements 120, 130 is bent to be substantially parallel to the land forming face of the board 110 to form the surface mount portions 122, 132. More specifically, the surface mount portions 122, 132 are respectively made from two parts, that is, a first part that is substantially parallel to the land forming face of the board 110 and a second part that is bent at a tip of the first portion along an end face of a base part 152 of the retainer member 150 that is mentioned later. Further, the outside element 120 (the surface mount portion 122) is electrically connected by a solder 160 to the land 111*a* of the GND pattern 111 as an electric potential standard formed on the board 110, and the inside element 130 (the surface mount portion 132) is electrically connected to, by the solder 160, the land 112*a* of the feeding pattern 112. In other words, the outside element 120 is considered as the GND line, and the inside element 130 is considered as the signal line.

Positional relationships of the two elements 120, 130 are important for performance (a resonance characteristic) of the antenna 140 having a so-called dipole structure where the inside element 130 is disposed at a predetermined interval in an inside of the outside element 120 extending in a spiral shape as stated above. For example, a resonance frequency changes and affects radiation characteristics when the capacity of a condenser formed by facing portions of the two elements 120, 130 changes due to the change of the distance of the facing portions of the two elements 120, 130. In addition, when a degree of leaning of the elements 120, 130 in the vertical direction of the board 110 changes (in other words, when the heights L1, L2 of the elements 120, 130 from the board surface change), the distance (a height direction) of the facing portions of the elements 120, 130 changes to affect the radiation characteristics, because the component of the vertical direction against the board 110 contributes to the radiation characteristics Therefore, the retainer member 150 is configured, in contact with each of the elements 120, 130, to hold the two elements 120, 130 in the predetermined position relationships for maintaining the performance of the antenna 140 in a desired manner.

As for the structure of the retainer member 150, it, the structure, is not limited in particular to a specific shape as long as the retainer member 150 is in contact with the elements 120, 130 in order to hold the two elements 120,130. In the present embodiment, the elements 120, 130 and the retainer member 150 are molded in one body so that the retainer member 150 maintains the two elements 120, 130 in the predetermined positional relationships The integrally formed shape can simplify the structure of the antenna as described above. In addition, due to the close contact between the elements 120, 130 and the retainer member 150 by the integral molding, the above structure can improve a wavelength shortening effect that is to be mentioned later.

The retainer member 150 may be formed by using an electric insulation material made of the dielectric that bears the heat for implementing the antenna 140 on the board 110. The wavelength shortening effect of high-frequency current flowing to the elements 120, 130 that are in contact with the retainer member 150 is produced when the retainer member 150 made of the dielectric is used, and the resonance frequency of the antenna 140 is shifted to a lower frequency range. In other words, for the same resonance frequency, in comparison to the structure that does not have the arrangement of the dielectric, the antenna device 100 can have a shortened electric length (the length of the elements 120, 130) and can have the reduced height of the antenna 140 from the land forming face of the board 110 (i.e., the reduction of the volume of the antenna device 100). The above advantage can also be explained as the characteristic of the condenser consisting of the two elements 120, 130 that has the increased capacity as the dielectric constant of the dielectric increases, thereby making the resonance frequency of the antenna 140 (i.e., the LC series resonant circuit) lower. The antenna device 100 can have the smaller volume when the dielectric constant of the dielectric that forms the retainer member 150 is greater because of the increased influence of the wavelength shortening effect stated above. In the present embodiment, the dielectric having the dielectric constant value of 20 that is made of a mixture of resin and ceramics for heat resistance required for the reflow implementation is used to form the retainer member 150.

More practically, the retainer member 150 has a whorl part 151 corresponding to at least a part of the whorl portions 121, 131 of the two elements 120, 130 and a base part 152 corresponding to the surface mount portions 122, 132 as shown in FIGS. 1 to 4. The whorl part 151 is formed to cover the whorl portions 121, 131 from a bottom end (a connection edge with the surface mount portions 122, 132) of the whorl portions 121, 131 to a position that is slightly higher than an upper end, and has an inter-whorl part 151a in a substantially cylindrical shape that is interposed between an entire facing part of the whorl portions 121, 131 of the two elements 120, 130. When the retainer member 150 (the inter-whorl part 151*a*) is interposed between at least a part of the facing part of the whorl portions 121, 131 of the two elements 120, 130 in the above-described way, the resonance frequency of the antenna 140 can be shifted to a lower range by a wavelength shortening effect with the two elements held in a predetermined position. Particularly, as shown in the present embodiment, the retainer member 150 (the inter-whorl part 151*a* interposed between the entire facing part) can improve the retaining effect and the wavelength shortening effect.

In addition, in the present embodiment, the whorl part 151 is arranged to fill an entire space of the inside of the whorl portion 131 in the element 130, and has an inside whorl portion 151*b* that is in a substantially columnar shape in contact with the inside element 130. In other words, the whorl part 151 is in a columnar shape. Further, in a direction that is perpendicular to the land forming face of the board 110, the whorl part 151 is disposed between adjacent spirals of the outside element 120 and between adjacent spirals of the inside element 130. The retainer member 150 arranged at an inside of the whorl portion 131 of the inside element 130 and between the adjacent spirals of the elements 120, 130 in this manner contributes to the wavelength shortening effect. Therefore, the structure of the antenna 140 shifts a resonance frequency of the antenna 140 to a lower range and makes a volume of the antenna device 100 smaller.

In addition, the base part 152 of the retainer member 150 is layered on the GND pattern 111 in the present embodiment, and the surface mount portions 122, 132 are layered on the base part 152. In other words, the surface mount portions 122, 132 form a strip line structure As an example of the strip line structure, the base part 152 is constructed in a form of a plane rectangle that is bigger than the plane rectangle-shaped GND pattern 111 in the present embodiment, and the base part is layered on the GND pattern 111. In a layered state, if seen from above of the land forming face of the board 110, the GND pattern 111 is covered by the base part 152, and only the land 111*a* is exposed. In addition, on one surface of the base part 152 that is opposite to a surface that contacts with the GND patter 111, the surface mount portions 122, 132 of the elements 120, 130 are integrally held with their surfaces exposed. When the surface mount portions 122, 132 are held in the strip line structure using the retainer member 150 in this manner, the impedance of the antenna 140 can be stabilized, thereby preventing a variation of the performance of the antenna 140. Further, because the retainer member 150 (the base part 152) layered on the GND pattern 111 contributes to a wavelength shortening effect, the resonance frequency of the antenna 140 is shifted to a lower range, thereby contributing to a further volume reduction of the antenna device 100. Furthermore, because the surface mount portions 122, 132 are held on the surface of the base part 152 in the present embodiment, the elements 120, 130 are held firmly by the retainer member 150. Furthermore, the land 111*a*, 112*a* can be accurately positioned.

The antenna device 100 having a structure described above can be manufactured in a procedure shown below. First, a conductor wire is processed to form each of two elements 120, 130. Then, the elements 120, 130 are arranged in a mold as inserted parts, and materials of the retainer member 150 are injected into the said mold. The antenna 140 (the elements 120, 130) and the retainer member 150 are unified in this manner. Then, the board 110 is prepared separately from the above process, and the solder 160 is applied by a screen-printing or by using a dispenser on the lands 111*a*, 112*a*. Then, the base part 152 of the retainer member 150 is positioned on the GND pattern 111 of the board 110 that is prepared separately so that the surface mount portions 122, 132 are positioned on corresponding lands 111*a*, 112*a*. Then, in the positioning state described above, the surface mount portions 122, 132 and corresponding lands 111*a*, 112*a* are joined by the solder 160, and the antenna device 100 is formed as described above.

Because the predetermined positional relationships of the two elements 120, 130 in the present embodiment can be achieved by the retainer member 150 in the antenna device 100 in the above-described manner, both of the two elements 120, 130 are disposed on the land forming face side of the board 110, and the performance of the antenna 140 can be maintained when both elements 120, 130 are structured to extend away from the land forming face in the spiral shape.

In addition, the resonance frequency of the antenna can be shifted to a lower range by the wavelength shortening effect of the dielectric that constitutes the retainer member 150. In other words, if the antenna 140 has the same resonance frequency, the electric length of the antenna 140 can be shortened in comparison to the structure that does not have the dielectric arranged therein, thereby contributing the volume reduction of the antenna device 100. Because the dielectric having the higher dielectric constant in comparison to the insulation material for forming the board 110 is used to constitute the retainer member 150 in the present embodiment in particular, the volume of the antenna device 100 can be further reduced.

Figure 5:
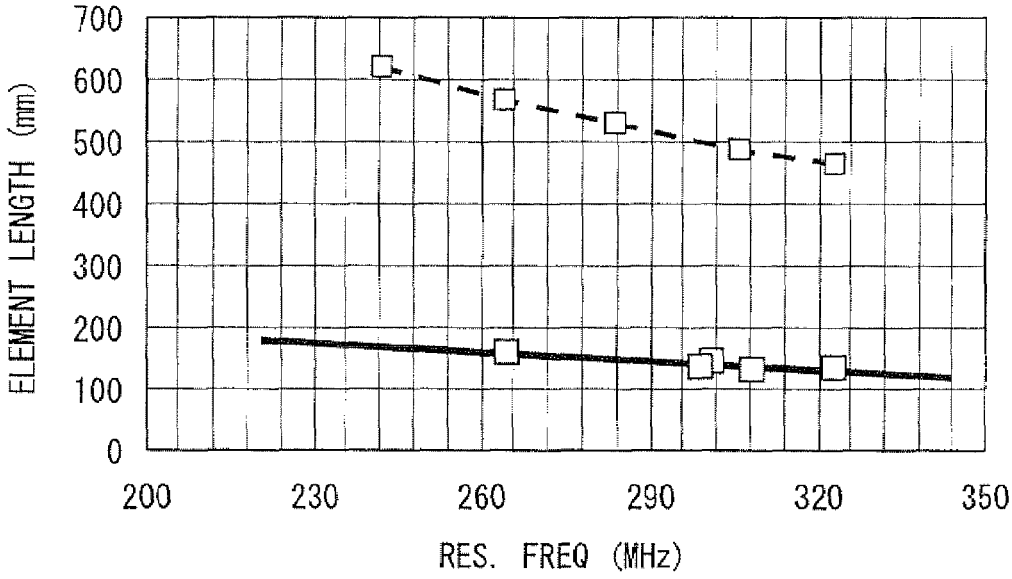
FIG. 5 shows a diagram of a wavelength shortening effect of the antenna in the present invention.

In addition, the inventor of the present invention has confirmed an advantageous effect of the volume reduction by the wavelength shortening in the antenna device 100 that is structured in the above-described manner The result of the effect is shown in FIG. 5. FIG. 5 is a diagram showing a wavelength shortening effect by the electromagnetic field simulation. The diagram shows the characteristic of the antenna device 100 (including the retainer member 150 consisting of the dielectrics of dielectric constant value of 20) in the present embodiment by a solid line as well as the characteristic of an equivalent of the antenna device 100 of the present embodiment except that there is no retainer member 150 in the equivalent by a dashed line as a comparison object. According to the antenna device 100 in the present embodiment, as shown in FIG. 5, the entire element length (the electric length) of the antenna can be reduced to about 0.33 time in comparison to the antenna without the retainer member 150 if the resonance frequency is kept to the same value. In other words, the volume of the antenna device 100 can be reduced.

Further, as connecting ends to be connected to corresponding lands 111*a*, 112*a*, each of the elements 120, 130 have substantially parallel portions in the surface mount portions 122, 132 including a part that is substantially parallel to the land forming face of the board 110. Therefore, efficiency of the implementation of the antenna 140 on the board 110 can be improved because implementation of the two elements 120, 130 can collectively be performed by reflow. Furthermore, the surface mount portions 122,132 can be easily positioned on the corresponding lands 111*a*, 112*a* for the efficiency of implementation because the antenna 140 (the elements 120, 130) is implemented on the board 110 in a state that the retainer member 150 holds the two elements 120, 130 in the present embodiment.

SECOND EMBODIMENT

Figure 6:
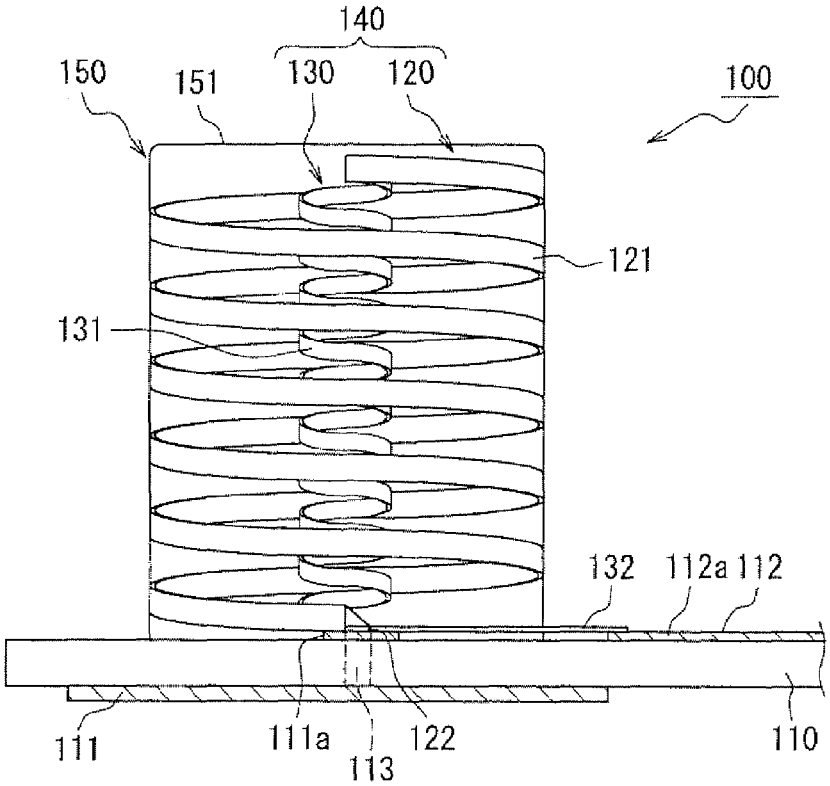
FIG. 6 shows a side view of the antenna in a second embodiment of the present invention.

The second embodiment of the present invention is explained based on FIG. 6. FIG. 6 is a perspective view of the antenna in the antenna device 100 in a second embodiment. In addition, FIG. 6 corresponds to FIG. 4 shown in the first embodiment.

The antenna device 100 in the first embodiment and the antenna device 100 in the second embodiment have common parts, and the description in the following focuses on the difference of the second embodiment from the first one. In addition, like parts have like numbers in the second embodiment.

In the first embodiment, the retainer member 150 has the whorl part 151 and the base part 152, and the surface mount portions 122, 132 are layered on the GND pattern 111 with the base part 152 interposed therebetween, and the surface mount portions 122, 132 has the strip line structure as an example. In contrast, as advantageous characteristics, the retainer member 150 has only the whorl part 151 as shown in FIG. 6 in the present embodiment, and the GND pattern 111 is established on a back side of the land forming face of the board 110, and the surface mount portions 122, 132 are layered on the GND pattern 111 through the board 110, and the surface mount portions 122, 132 are formed in the strip line structure. More specifically, the GND pattern 111 is formed on a reverse side of the land forming face of the board 110 in a corresponding manner to the placement position of the antenna 140, and the GND pattern 111 is connected to the land 111*a* through a connection via 113. Further, the whorl part 151 of the retainer member 150 is disposed on the land forming face of the board 110 for holding the elements 120, 130, and the surface mount portions 122, 132 are connected with each other by the solder 160 (omitted in FIG. 6) on facing positions of the corresponding lands 111*a*, 112*a*. The structure described above can stabilize the impedance of the antenna 140 in the surface mount structure. In addition, in FIG. 6, the surface mount portions 122, 132 do not have the tip part bent at an end of the substantially parallel part of the surface mount portions 122, 132 that is substantially parallel to the land forming face of the board 110 because there is no the base part 152 on the retainer member 150.

THIRD EMBODIMENT

Figure 7:
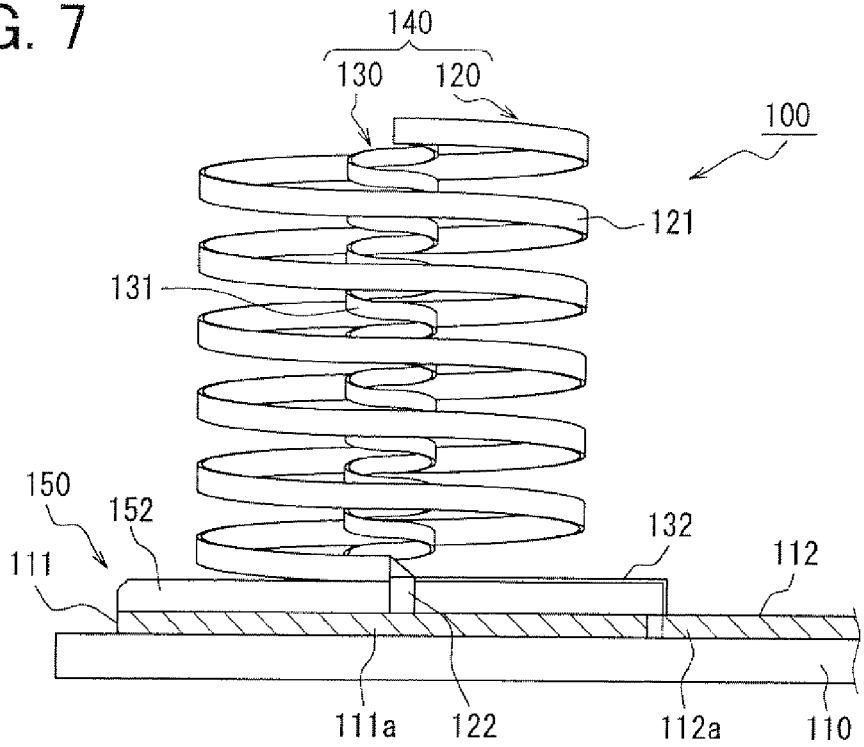
FIG. 7 shows a side view of the antenna in a third embodiment of the present invention.

The third embodiment of the present invention is explained based on FIG. 7. FIG. 7 is a perspective view of the antenna in the antenna device 100 in the third embodiment. In addition, FIG. 7 corresponds to FIG. 4 shown in the first embodiment.

The antenna device 100 in the first embodiment and the antenna device 100 in the third embodiment have common parts, and the description in the following focuses on the difference of the third embodiment from the first one. In addition, like parts have like numbers in the third embodiment.

In the first embodiment, the retainer member 150 has the whorl part 151 and the base part 152. In contrast, the retainer member 150 is characterized by a point that the retainer member 150 only has the base part 152 as shown in FIG. 7 in the present embodiment. Because the base part 152 holds the surface mount portions 122, 132 of the elements 120, 130, and is disposed next to one ends (the connection side with the surface mount portions 122, 132) of the whorl portions 121, 131, thereby contributing to a wavelength shortening effect. Therefore, the resonance frequency of the antenna 140 is shifted to a lower range thereby reducing the volume of the antenna device 100. Further, the performance of the antenna 140 is maintained in comparison to the structure that lacks the retainer member 150 because the retainer member 150 holds the surface mount portions 122, 132 of the elements 120, 130.

FOURTH EMBODIMENT

Figure 8:
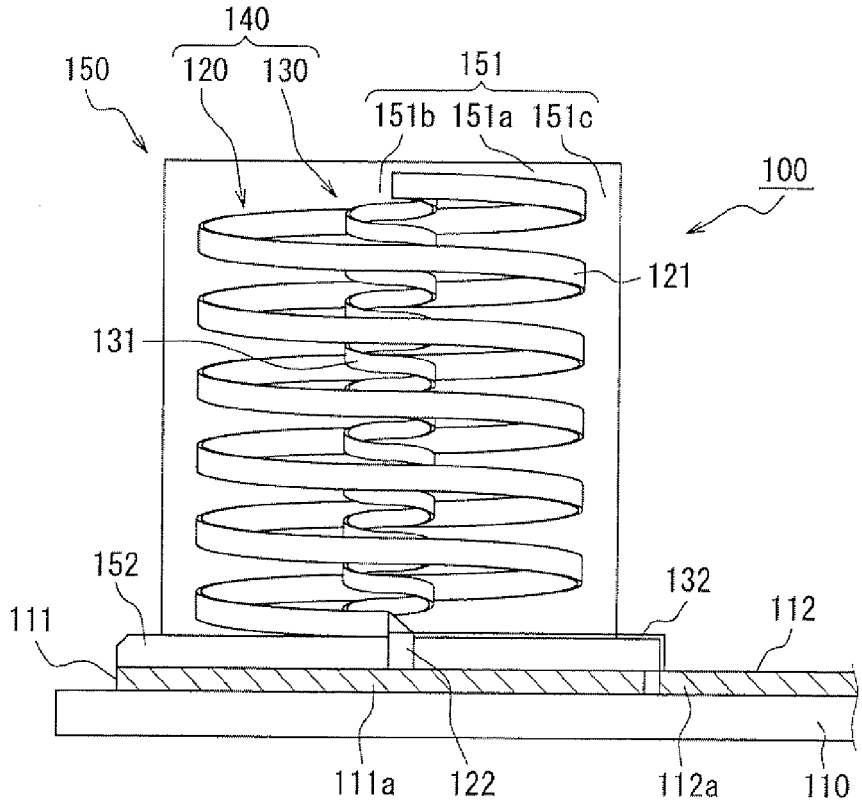
FIG. 8 shows a side view of the antenna in a fourth embodiment of the present invention.

The fourth embodiment of the present invention is explained based on FIG. 8. FIG. 8 is a perspective view of the antenna in the antenna device 100 in the fourth embodiment. In addition, FIG. 8 corresponds to FIG. 4 shown in the first embodiment.

The antenna device 100 in the first embodiment and the antenna device 100 in the fourth embodiment have common parts, and the description in the following focuses on the difference of the fourth embodiment from the first one. In addition, like parts have like numbers in the fourth embodiment.

In the first embodiment, the retainer member 150 has the inter-whorl part 151*a* between the spiral and the inside whorl portion 151*b* in the whorl part 151. In contrast, the whorl part 151 in the present embodiment, as shown in FIG. 8, is characterized by a point that the whorl part 151 has an addition of an outside whorl portion 151*c* that is disposed at an outside of the outside element 120 in contact with the outside element 120. In other words, in the present embodiment, the whorl part 151 is formed in a substantially columnar shape that has a greater diameter than the outer diameter of the outside element 120, and the whorl portions 121, 131 of the elements 120,130 are completely covered by the retainer member 150. The retainer member 150 arranged on the circumference side of the outside element 120 in this manner contributes to a wavelength shortening effect. Therefore, the resonance frequency of the antenna 140 is shifted to a lower range thereby reducing the volume of the antenna device 100.

In addition, in the present embodiment, as the whorl portion 151, the inter-whorl part 151*a*, the inside whorl portion 151*b* and the outside whorl portion 151*c* are provided. However, the whorl portion 151 may only have at least one of the inter-whorl part 151*a* the inside whorl portion 151*b* and the outside whorl portion 151*c*. For example, the whorl portion 151 may have the inter-whorl part 151*a* and the outside whorl portion 151*c*, or may have the inside whorl portion 151*b* and the outside whorl portion 151*c*. Besides, the whorl portion 151 may have only one of the inter-whorl part 151*a* the inside whorl portion 151*b* and the outside whorl portion 151*c*.

Although the present invention has been fully described in connection with the preferred embodiment thereof with reference to the accompanying drawings, it is to be noted that various changes and modifications will become apparent to those skilled in the art.

For example, the antenna device 100 is applied to a vehicular keyless receiver in the present embodiment. However, the antenna device 100 shown in the present embodiment may also be applied to different devices besides the above example. That is, the antenna device may be applied to a device such as smart entry systems or the like. In addition, the antenna device may also be applied to a transmitter besides the receiver.

Further, the whorl part 151 is formed to be slightly higher than the whorl portions 121, 131 from the bottom end, that is, from the connection end with the surface mount portions 122, 132 in the present embodiment. However, the whorl part 151 may at least partially contact with a portion of the whorl portions 121, 131 of the elements 120, 130 in a direction that is substantially perpendicular to the land forming face of the board 110 for holding the elements 120, 130 in the predetermined positional relationships to achieve the wavelength shortening effect.

In the first to fourth embodiments, the retainer member 150 having the base part 152 is formed to have the tip portion on the substantially parallel portion of the surface mount portions 122, 132 that is substantially parallel to the land forming face of the board 110, and the tip portion is bent along the land forming face of the board 110. However, the surface mount portions 122, 132 may be formed in a different manner. That is, the surface mount portion may only have the substantially parallel portion that is substantially parallel to the land forming face of the board 110. In other words, the surface mount portion may take any form as long as it can be surface-mounted, preferably by reflow soldering.

Figure 9:
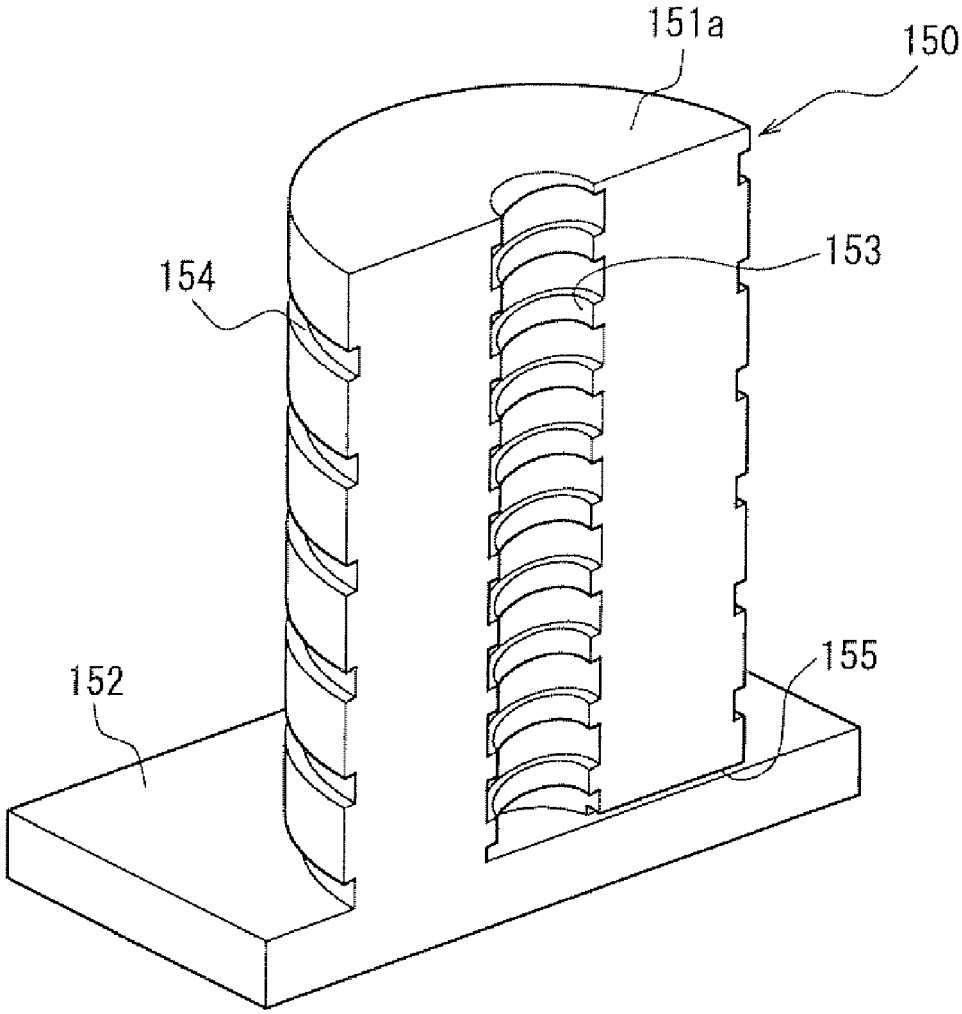
FIG. 9 shows a modification of an embodiment of the present invention.

In the present embodiment, the retainer member 150 is shown as a member that is integrally formed with the elements 120, 130. However, the elements 120, 130 may be fixed on the retainer member 150 to have the predetermined positional relationship. For example, as shown in a perspective view of FIG. 9, the retainer member 150 is formed in one body that is molded to include the inter-whorl portion 151*a* and the base part 152, to bind the whorl portion 131 of the inside element 130 by two pieces of the retainer member 150. Then, the whorl portion 131 of the inside element 130 is held by one of the retainer members 150 in a gutter 153 on an inner periphery, to be bound by the other piece of the retainer member 150 that is, for example, engaged with the first piece. Then, the whorl portion 121 of the outside element 120 is put in a gutter 154 on an outer periphery of the retainer member 150 by using the resilience of the retainer member 150. The retainer member 150 may hold the two elements 120, 130 in the above-described manner The reference number 155 in FIG. 9 shows a gutter that holds the surface mount portion 132, in this case.

In the present embodiment, the whorl portions 121, 131 of the elements 120, 130 and the surface mount portions 122, 132 are respectively formed by one conductive wire However, the whorl portions 121, 131 and the surface mount portions 122, 132 may be formed by using separate members to be connected to serve as the elements 120, 130.

In the present embodiment, the retainer member 150 is formed as a single member formed by injection molding. However, the retainer member 150 may be formed by plural members. For example, the whorl portion 151 and the base part 152 may be formed as separate members, and may serve as the retainer member 150 in a combined structure. Further, the whorl portion 151 may be formed by separate members of the inter-whorl part 151*a* and the inside whorl portion 151*b*.

Such changes and modifications are to be understood as being within the scope of the present invention as defined by the appended claims.

What is claimed is:

1. An antenna apparatus comprising:

a substrate having a GND pattern land and a power supply pattern land disposed on a same surface;

an antenna element including an external element that has a helically extending portion extending away from a land formation surface of the substrate and an internal element that has another helically extending portion extending along an axis of the external element at an inside of the external element in a detached manner from the external element; and a retainer in contact with the external element and the internal element on the land formation surface for retaining the external element and the internal element in a predetermined positional relationship with each other, wherein one of the two elements included in the antenna element serves as a signal line and an other of the two elements included in the antenna element serves as a GND line, the retainer is made of a dielectric material, each of the external element and the internal element has a surface mount portion that is, as a connecting end to the helically extending portion, substantially parallel with the land formation surface of the substrate on one end that is used for fixation on the substrate, and the surface mount portion of each of the two elements is connected to respectively different lands.

2. The antenna apparatus of claim 1, wherein the two elements in the antenna element and the retainer are integrally formed as one component.

3. The antenna apparatus of claim 1, wherein the retainer is at least partially interposed between two facing areas of respective elements in the antenna element.

4. The antenna apparatus of claim 3, wherein the retainer is entirely interposed between the two facing areas of respective elements in the antenna element.

5. The antenna apparatus of claim 3, wherein the retainer is disposed in an inside of the internal element in contact with the internal element.

6. The antenna apparatus of claim 3, wherein the retainer is disposed on an outside of the external element in contact with the external element.

7. The antenna apparatus of claim 1, wherein the GND pattern is disposed on the land formation surface of the substrate in a corresponding manner to positions of the two elements in the antenna element, the surface mount portion has a strip structure where the surface mount portion is disposed in a layering manner on the GND pattern by the retainer, and a tip portion of the surface mount portion is connected to a corresponding land.

* * * * *